US009186551B1

(12) United States Patent
Smith

(10) Patent No.: US 9,186,551 B1
(45) Date of Patent: Nov. 17, 2015

(54) CRAWLING EXERCISE DEVICE

(71) Applicant: Allen D. Smith, Bradenton, FL (US)

(72) Inventor: Allen D. Smith, Bradenton, FL (US)

( * ) Notice: Subject to any disclaimer, the term of this patent is extended or adjusted under 35 U.S.C. 154(b) by 0 days.

(21) Appl. No.: 14/445,937

(22) Filed: Jul. 29, 2014

(51) Int. Cl.

| | |
|---|---|
| ***A63B 22/00*** | (2006.01) |
| ***A63B 69/18*** | (2006.01) |
| ***A63B 71/00*** | (2006.01) |
| ***A63B 24/00*** | (2006.01) |

(52) U.S. Cl.
CPC ..... *A63B 24/0087* (2013.01)

(58) Field of Classification Search
CPC ..... A63B 24/0087; A63B 24/2024; A63B 24/009; A63B 24/0093; A63B 22/00; A63B 22/0015; A63B 22/18; A63B 22/20; A63B 22/201; A63B 22/203; A63B 2022/0043
USPC ..... 482/1, 8, 51, 66, 68, 70–72, 79, 92, 482/110, 114, 115, 139, 142
See application file for complete search history.

(56) References Cited

U.S. PATENT DOCUMENTS

| | | | | | |
|---|---|---|---|---|---|
| 3,363,335 | A * | 1/1968 | Burhns | A61H 1/02 | 434/255 |
| 3,582,069 | A * | 6/1971 | Flick | A63B 21/154 | 434/255 |
| 3,589,720 | A * | 6/1971 | Agamian | A63B 21/012 | 310/69 |
| 4,364,559 | A * | 12/1982 | Valentine | A63B 21/055 | 482/130 |
| 4,679,786 | A * | 7/1987 | Rodgers | A63B 21/154 | 482/54 |
| 4,799,475 | A * | 1/1989 | Iams | A63B 21/1496 | 434/255 |
| 5,224,909 | A * | 7/1993 | Hamilton | A63B 21/154 | 482/51 |
| 5,230,677 | A * | 7/1993 | Chi | A63B 21/154 | 434/253 |
| 5,279,531 | A * | 1/1994 | Jen-Huey | A63B 23/0417 | 482/51 |
| 5,503,609 | A * | 4/1996 | Bull | A63B 21/154 | 482/51 |
| 5,529,554 | A * | 6/1996 | Eschenbach | A63B 22/0664 | 482/57 |
| 5,593,372 | A * | 1/1997 | Rodgers, Jr. | A63B 22/001 | 482/51 |
| 5,607,374 | A * | 3/1997 | Hesse | A63B 22/203 | 434/255 |
| 6,368,254 | B1 * | 4/2002 | Wall | A63B 21/055 | 482/122 |
| 7,462,139 | B2 * | 12/2008 | Stafiej | A63B 22/02 | 482/51 |
| 7,651,446 | B1 | 1/2010 | Eschenbach | | |
| 7,780,585 | B1 | 8/2010 | Rivas | | |
| 7,951,050 | B2 * | 5/2011 | Raumann | A63B 22/0015 | 482/51 |
| 2003/0119635 | A1 * | 6/2003 | Arbuckle | A63B 23/0405 | 482/142 |
| 2008/0015095 | A1 * | 1/2008 | Savsek | A63B 21/0455 | 482/121 |
| 2008/0248935 | A1 * | 10/2008 | Solow | A63B 21/023 | 482/142 |
| 2009/0105050 | A1 * | 4/2009 | Mayo | A63B 21/00192 | 482/70 |
| 2010/0248919 | A1 * | 9/2010 | Zhou | A63B 21/154 | 482/139 |
| 2011/0039667 | A1 * | 2/2011 | Teng | A63B 23/03541 | 482/142 |
| 2012/0108405 | A1 * | 5/2012 | Milo | A63B 22/203 | 482/142 |

* cited by examiner

*Primary Examiner* — Stephen Crow
*Assistant Examiner* — Garrett Atkinson
(74) *Attorney, Agent, or Firm* — Crossley Patent Law

(57) ABSTRACT

A crawling exercise device having a base with a quartet of spaced apart notches disposed within the top side, a block slidably disposed above each notch, respectively, a pad disposed atop each block, a wheel connected to each block through each notch, each wheel supported on the bottom side interior, a first connecting rod in operational communication with the wheels of the first small block and the first large block, a second connecting rod in operational communication with the wheels of the second small block and the second large block, a dual inertia wheel disposed at the first end, each of the first connecting rod and the second connecting rod pivotally affixed to the dual inertia wheel, the first connecting rod affixed to the dual inertia wheel 180 degrees out of phase with the second connecting rod, wherein sliding movement of the blocks turns the dual inertia wheel.

2 Claims, 3 Drawing Sheets

FIG. 1

CRAWLING EXERCISE DEVICE

BACKGROUND OF THE INVENTION

Various types of exercise devices are known in the prior art. However, what is needed is a crawling exercise device that provides very nearly whole body exercise, without impact.

FIELD OF THE INVENTION

The present invention relates to exercise apparatuses, and more particularly, to a crawling exercise device that provides whole body workout, without impact.

SUMMARY OF THE INVENTION

The general purpose of the present crawling exercise device, described subsequently in greater detail, is to provide a crawling exercise device that has many novel features that result in a crawling exercise device which is not anticipated, rendered obvious, suggested, or even implied by prior art, either alone or in combination thereof.

To accomplish this the crawling exercise device comprises a quadrilateral frusto-pyramidal base having a first end spaced apart from a second end, a first side spaced apart from a second side, a top side spaced apart from a bottom side, and a bottom side interior. A quartet of spaced apart trays is disposed within the top side and comprises a first small tray, a second small tray, a first large tray, and a second large tray. The first small tray is disposed most proximal the first end and the first side. The second small tray is disposed most proximal the first end and the second side. The first large tray is disposed most proximal the second end and the first side. The second large tray is disposed most proximal the second end and the second side.

A notch is disposed within each tray. The notches are parallel with the first side and the second side. A first small block is slidably disposed within the first small tray. A second small block is slidably disposed within the second small tray. A first large block is slidably disposed within the first large tray. A second large block is slidably disposed within the second large tray. A pad is disposed atop each block. A wheel is connected to each block through each notch, respectively. Each wheel is supported on the bottom side interior.

A first connecting rod is in operational communication with the wheels of the first small block and the first large block. A second connecting rod is in operational communication with the wheels of the second small block and the second large block. A dual inertia wheel is disposed at the first end. Each of the first connecting rod and the second connecting rod are pivotally affixed to the dual inertia wheel. The first connecting rod is affixed to the dual inertia wheel 180 degrees out of phase with the second connecting rod. The sliding movement of the blocks turns the dual inertia wheel via the connecting rods.

A housing surrounds the dual inertia wheel. A CPU is disposed within the housing. The CPU is in operational communication with the dual inertia wheel. A display is disposed within the housing. The display is in operational communication with the CPU. The display provides a plurality of information to a user. Information consists of but is not limited to time of exercise and caloric expenditure.

It is important to note that the user need not limit themselves to hand contact only on the first small block, as elbow use is also accommodated. Also, the user is not limited to knee contact only on the large pads, as feet are also usable. It is therefore apparent to one skilled in the art that using hands and feet provides exercise for all muscles.

Thus has been broadly outlined the more important features of the present crawling exercise device so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
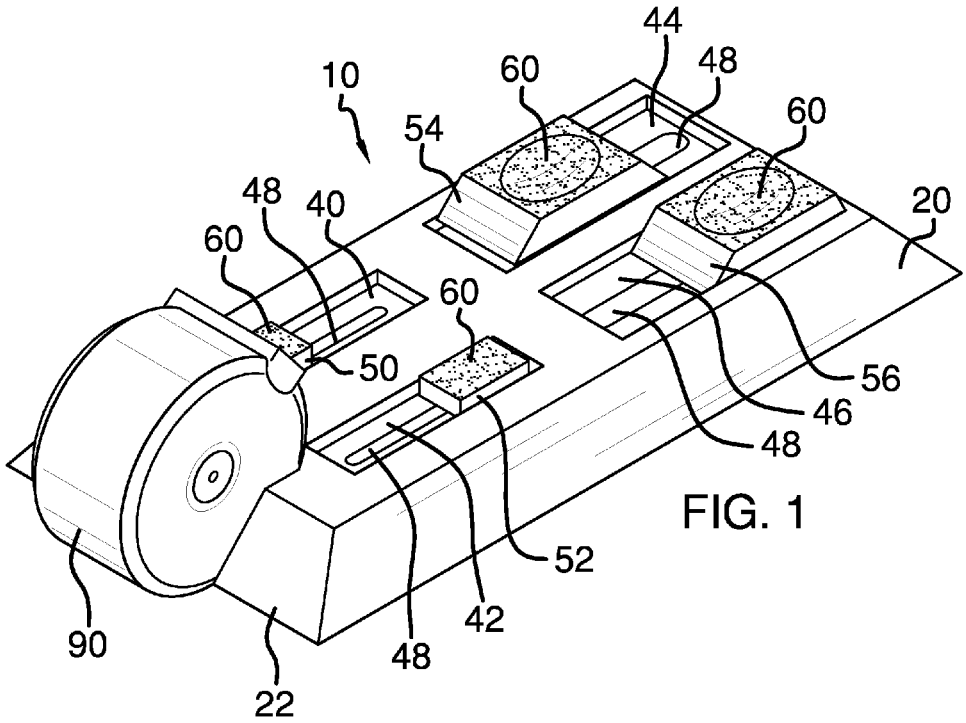
FIG. 1 is a top side second side perspective view.
Figure 2:
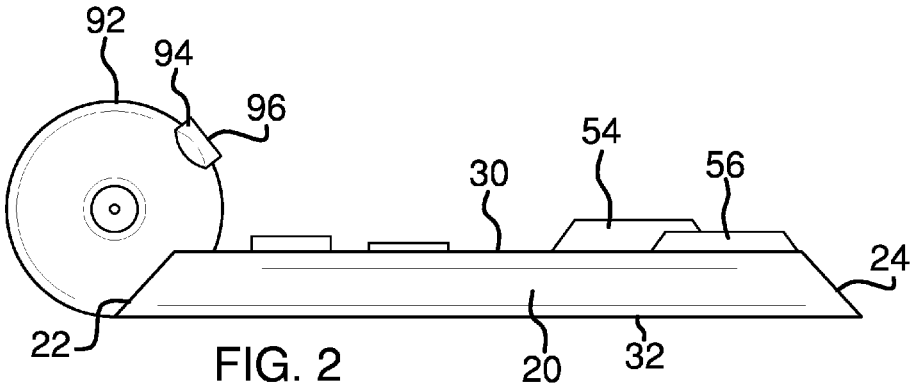
FIG. 2 is a second side view.
Figure 3:
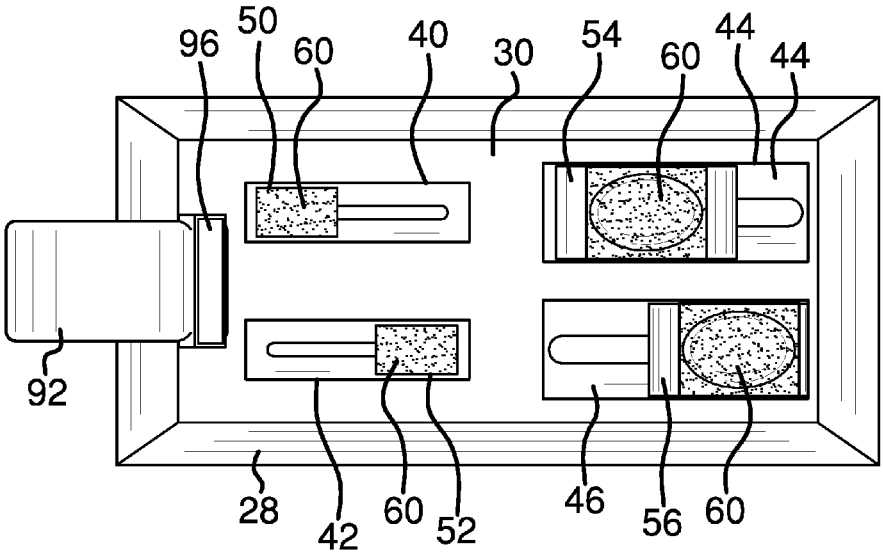
FIG. 3 is a top plan view.
Figure 4:
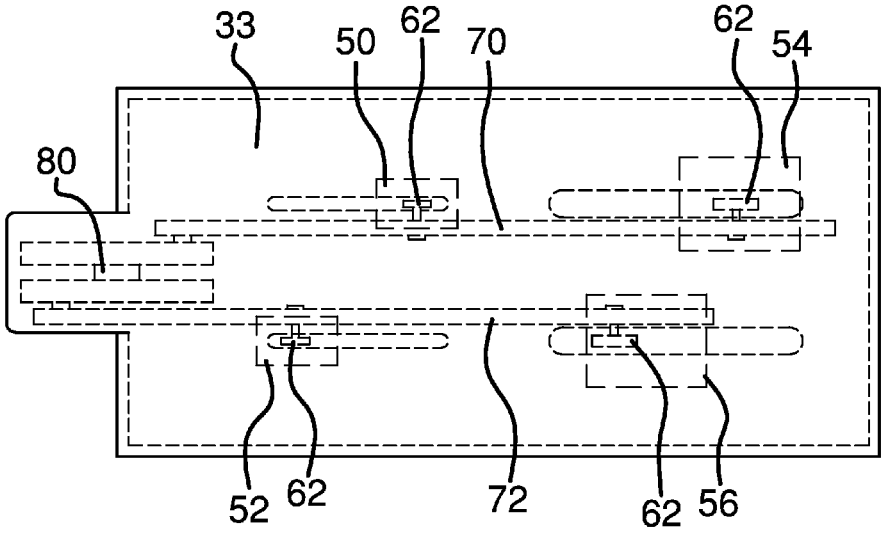
FIG. 4 is a detail view.
Figure 5:
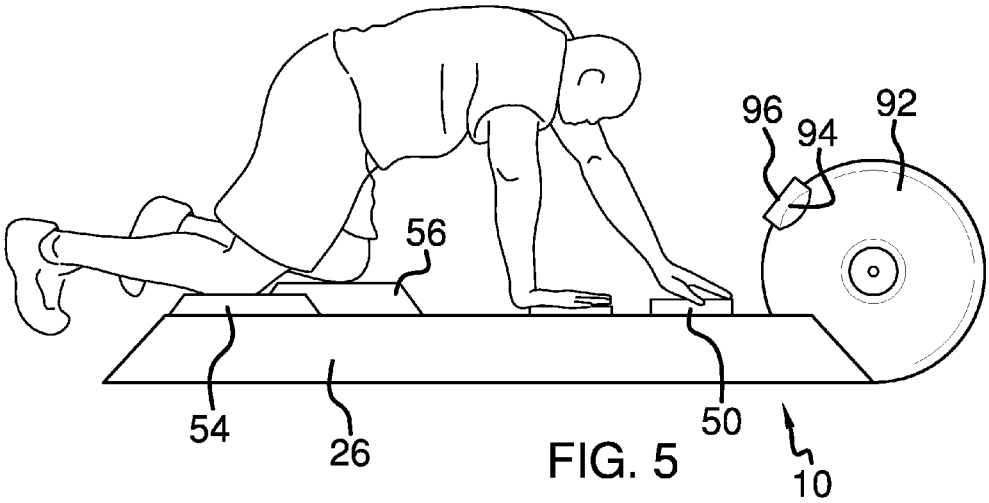
FIG. 5 is an in use view.

With reference now to the drawings, and in particular FIGS. 1 through 5 thereof, an example of the crawling exercise device employing the principles and concepts of the present crawling exercise device and generally designated by the reference number 10 will be described.

The crawling exercise device 10 comprises a quadrilateral frusto-pyramidal base 20 having a first end 22 spaced apart from a second end 24, a first side 26 spaced apart from a second side 28, a top side 30 spaced apart from a bottom side 32, and a bottom side interior 33. The frusto-pyramidal base 20 offers best stability without being excessively large. A quartet of spaced apart trays is disposed within the top side 30 and comprises a first small tray 40, a second small tray 42, a first large tray 44, and a second large tray 46. The first small tray 40 is disposed most proximal the first end 22 and the first side 26. The second small tray 42 is disposed most proximal the first end 22 and the second side 28. The first large tray 44 is disposed most proximal the second end 24 and the first side 26. The second large tray 46 is disposed most proximal the second end 24 and the second side 28.

A notch 48 is disposed within each tray. The notches 48 are parallel with the first side 26 and the second side 28. A first small block 50 is slidably disposed within the first small tray 40. A second small block 52 is slidably disposed within the second small tray 42. A first large block 54 is slidably disposed within the first large tray 44. A second large block 56 is slidably disposed within the second large tray 46. A pad 60 is disposed atop each block. A wheel 62 is connected to each block through each notch 48, respectively. Each wheel 62 is supported on the bottom side interior 33.

A first connecting rod 70 is in operational communication with the wheels 62 of the first small block 50 and the first large block 54. A second connecting rod 72 is in operational communication with the wheels 62 of the second small block 52 and the second large block 56. A dual inertia wheel 80 is disposed at the first end 22. Each of the first connecting rod 70 and the second connecting rod 72 are pivotally affixed to the dual inertia wheel 80. The first connecting rod 70 is affixed to the dual inertia wheel 80 180 degrees out of phase with the second connecting rod 72. A sliding movement of the blocks turns the dual inertia wheel 80.

A housing 92 surrounds the dual inertia wheel 80. A CPU 94 is disposed within the housing 92. The CPU 94 is in operational communication with the dual inertia wheel 80. A display 96 is disposed within the housing 92. The display 96 is in operational communication with the CPU 94. The display 96 provides a plurality of information to a user. Information consists of but is not limited to time of exercise and caloric expenditure.

What is claimed is:

1. A crawling exercise device comprising:

a base having a first end spaced apart from a second end, a first side spaced apart from a second side, a top side spaced apart from a bottom side, a bottom side interior;

a quartet of spaced apart notches disposed within the top side, the notches parallel with the first side and second side;

a block slidably disposed above each notch, respectively;

a pad disposed atop each block;

a wheel connected to each block through each notch, respectively, each wheel supported on the bottom side interior;

a first connecting rod in operational communication with the wheels of the blocks adjacent the first side;

a second connecting rod in operational communication with the wheels of the blocks adjacent the second side;

a dual inertia wheel disposed at the first end, each of the first connecting rod and the second connecting rod pivotally affixed to the dual inertia wheel, the first connecting rod affixed to the dual inertia wheel 180 degrees out of phase with the second connecting rod;

wherein a sliding movement of the blocks turns the dual inertia wheel;

a housing surrounding the dual inertia wheel;

a CPU disposed within the housing, the CPU in operational communication with the dual inertia wheel; and a display within the housing, the display in operational communication with the CPU;

wherein the display provides a plurality of information to a user.

2. A crawling exercise device comprising:

a quadrilateral frusto-pyramidal base having a first end spaced apart from a second end, a first side spaced apart from a second side, a top side spaced apart from a bottom side, a bottom side interior;

a quartet of spaced apart trays disposed within the top side comprising a first small tray disposed most proximal the first end first side;

a second small tray disposed most proximal the first end second side;

a first large tray disposed most proximal the second end first side;

a second large tray disposed most proximal the second end second side;

a notch disposed within each tray, the notches parallel with the first side and second side;

a first small block slidably disposed within the first small tray;

a second small block slidably disposed within the second small tray;

a first large block slidably disposed within the first large tray;

a second large block slidably disposed within the second large tray;

a pad disposed atop each block;

a wheel connected to each block through each notch, respectively, each wheel supported on the bottom side interior;

a first connecting rod in operational communication with the wheels of the first small block and the first large block;

a second connecting rod in operational communication with the wheels of the second small block and the second large block;

a dual inertia wheel disposed at the first end, each of the first connecting rod and the second connecting rod pivotally affixed to the dual inertia wheel, the first connecting rod affixed to the dual inertia wheel 180 degrees out of phase with the second connecting rod;

wherein sliding movement of the blocks turns the dual inertia wheel;

a housing surrounding the dual inertia wheel;

a CPU disposed within the housing, the CPU in operational communication with the dual inertia wheel; and a display within the housing, the display in operational communication with the CPU;

wherein the display provides a plurality of information to a user.

* * * * *